US008738280B2

(12) United States Patent
Haran

(10) Patent No.: US 8,738,280 B2
(45) Date of Patent: May 27, 2014

(54) METHODS FOR ACTIVITY REDUCTION IN PEDESTRIAN-TO-VEHICLE COMMUNICATION NETWORKS

(75) Inventor: Onn Haran, Bnei Dror (IL)

(73) Assignee: Autotalks Ltd., Kfar Netter (IL)

( * ) Notice: Subject to any disclaimer, the term of this patent is extended or adjusted under 35 U.S.C. 154(b) by 89 days.

(21) Appl. No.: 13/468,081

(22) Filed: May 10, 2012

(65) Prior Publication Data

US 2012/0316768 A1 Dec. 13, 2012

Related U.S. Application Data

(60) Provisional application No. 61/494,977, filed on Jun. 9, 2011, provisional application No. 61/598,982, filed on Feb. 15, 2012.

(51) Int. Cl.
*G06G 7/78* (2006.01)

(52) U.S. Cl.
USPC ..... 701/300; 701/1; 701/2; 701/37; 701/70; 701/117; 701/201; 701/204; 701/301; 704/258; 704/260; 707/2; 703/27; 713/320; 455/69; 455/410; 455/414.2; 455/418; 455/435.1; 455/456; 455/456.1; 455/456.5; 342/360; 382/387; 340/5.72; 340/436; 340/438; 340/443; 340/539.22; 340/925; 345/582; 52/749.1; 370/328; 370/338

(58) Field of Classification Search
USPC ..... 701/1, 2, 37, 70, 117, 201, 204, 300, 701/301; 704/258, 260; 707/2; 703/27; 713/320; 455/69, 410, 414.2, 418, 455/435.1, 456, 456.1, 456.5; 342/360; 382/287; 340/5.72, 436, 438, 443, 340/539.22, 925; 345/582; 52/749.1; 370/328, 338
See application file for complete search history.

(56) References Cited

U.S. PATENT DOCUMENTS

| | | | | |
|---|---|---|---|---|
| 4,723,304 | A * | 2/1988 | Maeda | 455/69 |
| 7,376,550 | B1 * | 5/2008 | Bokaemper et al. | 703/27 |
| 2002/0002457 | A1 * | 1/2002 | Holzapfel | 704/258 |
| 2002/0063656 | A1 * | 5/2002 | Gutowski | 342/360 |
| 2003/0053714 | A1 * | 3/2003 | Esaki et al. | 382/287 |

(Continued)

FOREIGN PATENT DOCUMENTS

JP 2004-219387 * 5/2004 ..... G01C 21/00

OTHER PUBLICATIONS

Chika Sugimoto et al., Prototype of pedestrian-to-vehicle communication system for the prevention of pedestrian accidents using both 3G wireless and WLAN communication, IEEE, 2008, p. 764-767, 978-1-4244-1653-0/08.

(Continued)

*Primary Examiner* — James Trammell
*Assistant Examiner* — Sanjeev Malhotra
(74) *Attorney, Agent, or Firm* — Menachem Nathan; Nathan & Associates Patent Agents Ltd.

(57) ABSTRACT

Methods for pedestrian unit (PU) communication activity reduction in pedestrian-to-vehicle communication networks include obtaining safety risk information for a pedestrian at risk for involvement in an accident and using the risk information to adjust a PU communication activity. In some embodiments, the activity reduction is achieved without implementing understanding of surroundings. In other embodiments, the activity reduction is based on risk assessment provided by vehicles. In some embodiments, the activity reduction includes PU transmission reduction. In some embodiments the transmission activity reduction may be followed by reception activity reduction for overall power consumption reduction.

17 Claims, 7 Drawing Sheets

(56) References Cited

U.S. PATENT DOCUMENTS

| | | | | |
|---|---|---|---|---|
| 2003/0117267 | A1* | 6/2003 | Tang et al. | 340/5.72 |
| 2003/0134648 | A1* | 7/2003 | Reed et al. | 455/456 |
| 2003/0193510 | A1* | 10/2003 | Shin et al. | 345/582 |
| 2004/0006427 | A1* | 1/2004 | Stiller | 701/300 |
| 2004/0116106 | A1* | 6/2004 | Shishido et al. | 455/414.2 |
| 2004/0130442 | A1* | 7/2004 | Breed et al. | 340/443 |
| 2004/0198386 | A1* | 10/2004 | Dupray | 455/456.1 |
| 2004/0230345 | A1* | 11/2004 | Tzamaloukas | 701/1 |
| 2004/0266457 | A1* | 12/2004 | Dupray | 455/456.5 |
| 2005/0131626 | A1* | 6/2005 | Ignatin | 701/117 |
| 2005/0192727 | A1* | 9/2005 | Shostak et al. | 701/37 |
| 2005/0253694 | A1* | 11/2005 | Kuznarowis | 340/436 |
| 2005/0273218 | A1* | 12/2005 | Breed et al. | 701/2 |
| 2006/0101781 | A1* | 5/2006 | Watts | 52/749.1 |
| 2006/0195231 | A1* | 8/2006 | Diebold et al. | 701/1 |
| 2006/0230018 | A1* | 10/2006 | Grichnik et al. | 707/2 |
| 2007/0262863 | A1* | 11/2007 | Aritsuka et al. | 340/539.22 |
| 2007/0287473 | A1* | 12/2007 | Dupray | 455/456.1 |
| 2008/0133126 | A1* | 6/2008 | Dupray | 701/204 |
| 2008/0301477 | A1* | 12/2008 | Gade et al. | 713/320 |
| 2009/0143987 | A1* | 6/2009 | Bect et al. | 701/301 |
| 2009/0146841 | A1* | 6/2009 | Basson et al. | 340/925 |
| 2009/0192688 | A1* | 7/2009 | Padmanabhan et al. | 701/70 |
| 2009/0259472 | A1* | 10/2009 | Schroeter | 704/260 |
| 2009/0271050 | A1* | 10/2009 | Niki et al. | 701/1 |
| 2009/0298499 | A1* | 12/2009 | Choi et al. | 455/435.1 |
| 2010/0076621 | A1* | 3/2010 | Kubotani et al. | 701/1 |
| 2010/0112978 | A1* | 5/2010 | Cho et al. | 455/410 |
| 2010/0142448 | A1* | 6/2010 | Schlicht et al. | 370/328 |
| 2010/0150120 | A1* | 6/2010 | Schlicht et al. | 370/338 |
| 2011/0195699 | A1* | 8/2011 | Tadayon et al. | 455/418 |
| 2011/0246055 | A1* | 10/2011 | Huck et al. | 701/201 |
| 2011/0248844 | A1* | 10/2011 | Elias et al. | 340/438 |

OTHER PUBLICATIONS

Chika Sugimoto et al., pedestrian-to-vehicle communication system for improving road safety using cellular phones, IEEE, 2008.

Chika Sugimoto et al., Development of Pedestrian-to-Vehicle Communication System Prototype for Pedestrian Safety Using both Wide-Area and Direct Communication, IEEE, 2008, p. 64-69, 1550-445X/08.

* cited by examiner

| |
|---|
| Pedestrian imposing safety risk<br>**500** |
| Pedestrian activity control<br>**502** |
| Activity re-enable distance<br>**504** |
| Activity re-enable direction<br>**506** |

FIG. 5

METHODS FOR ACTIVITY REDUCTION IN PEDESTRIAN-TO-VEHICLE COMMUNICATION NETWORKS

CROSS REFERENCE TO RELATED APPLICATIONS

This application is related to and hereby claims the priority benefit of commonly-owned U.S. Provisional Patent Application No. 61/494,977 titled "Method and apparatus for pedestrian to vehicle communication system" and filed Jun. 9, 2011, and U.S. Provisional Patent Application No. 61/598,982 titled "Method and apparatus for activity reduction in pedestrian-to-vehicle communication network" and filed Feb. 15, 2012.

FIELD

Embodiments disclosed herein relate in general to activity reduction in a pedestrian-to-vehicle communication network, and more specifically to methods for reducing the transmission and reception activity of a pedestrian communication unit (referred to hereinafter as "pedestrian unit", "personal unit" or "PU") by applying local decisions and decisions driven by analysis of vehicles.

BACKGROUND

The term "pedestrian-to-vehicle communication network" or "PVCN" refers to a scheme for detecting pedestrians by vehicles. It has many advantages over vision-based or radar-based systems, since pedestrians obstructed by vehicles can still be detected (observed). Each pedestrian is expected to have a small pedestrian communication unit associated therewith. The PU will interact with vehicles having integrated vehicle communication units.

The biggest challenges facing implementation of a PVCN are cost, power and positioning accuracy: the PU must be extremely low cost, even at the expense of limiting functionality. For example, a GPS (or similar) receiver may be too costly, and placing the GPS antenna in a position with a clear view to the sky may be too challenging. However, if a GPS receiver is not included, a PU may not have no location/positioning capability. Even if a GPS receiver is included, the processing power and memory size need to be kept very low, severely limiting the ability of the PU to have an accurate map of all roads and vehicles in its surroundings.

Power reduction may be achieved by limiting PU receive and transmit operations (referred to herein generally as "activity"). In Pus which include a GPS receiver, the "activity" may also refer to GPS receive activity. Achieving these without compromising the safety goals requires understanding of the road topology and assessment of risk from approaching vehicles. Road topology storage requires significant memory, while risk assessment requires extensive processing. Implementing these features will increase the PU cost beyond acceptability.

Transmission from a PU of a person sitting inside a vehicle may confuse processing of proximal vehicles, which might trigger a false alert for pedestrian safety risk. The conditions for pedestrian safety risk are different than those for vehicle risk. The sensitivity to raising pedestrian alerts will be likely higher than that to raising vehicle alerts. Therefore, there is a difference in risk analysis between pedestrians and vehicles and the two must not be confused. Another reason to reduce activity in a PVCN is to reduce network load and to increase battery life of a PU belonging to a pedestrian who is not posing a threat, such as a person sitting inside a vehicle.

There is therefore a need for, and it would be advantageous to have activity reduction in pedestrian-to-vehicle communication network without implementing understanding of surroundings in a pedestrian unit. It would also be advantageous to have such activity reduction even if the PU includes a GPS receiver.

SUMMARY

In various embodiments, there are provided methods for activity reduction in pedestrian-to-vehicle communication networks. In some embodiments, the activity reduction is achieved in a PU without implementing understanding of surroundings. In other embodiments, the activity reduction is based on risk assessment provided by vehicles. In some embodiments, the activity reduction includes PU transmission reduction. Transmission is more power consuming than reception, and it increases network load. In some embodiments the transmission activity reduction may be followed by reception activity reduction and, optionally, GPS receiver activity reduction for overall power consumption reduction.

In a first embodiment, a PU determines if the pedestrian is inside ("in") a vehicle (when inside a vehicle, the "pedestrian" is referred to henceforth as "person"), and disables its own operation as long as person remains in the vehicle. In a second embodiment, a PU determines a transmission activity factor based on risk assessment guidance from vehicles in order to reduce its own activity. In a third embodiment, a vehicle unit performs vehicle analysis of a pedestrian safety risk, and adjusts accordingly a transmission rate for a PU of a pedestrian not located in a vehicle.

Pedestrians may transmit on the same channel used by vehicles. However, it is more likely that a dedicated channel will be allocated for this purpose. The actual transmission channel does not impact the described methods. The methods disclosed herein allow manufacturing of a low-cost pedestrian unit powered by a battery with or without a GPS receiver.

In an embodiment, there is provided a method for activity reduction in a PVCN comprising steps of obtaining pedestrian safety risk information related to a particular person, and, based on the obtained pedestrian safety risk information, adjusting the communication activity of a PU associated with the particular person.

In an embodiment there is provided a method for activity reduction in a PVCN comprising steps of monitoring over a predetermined time period a distance between a particular pedestrian who carries a respective PU and a vehicle closest to the particular pedestrian to determine a distance deviation, and, if the distance deviation is lower than a predetermined threshold, reducing transmission activity by the respective PU.

In an embodiment there is provided a method for activity reduction in a PVCN comprising steps of identifying pedestrians at a given level of risk from accidents with vehicles, each pedestrian having a respective PU associated therewith, transmitting an activity control message which includes information related to the given level of risk relevant to a particular pedestrian, and adjusting the communication activity of a respective PU associated with the particular pedestrian based on the information received in the activity control message.

BRIEF DESCRIPTION OF THE DRAWINGS

Non-limiting embodiments are herein described, by way of example only, with reference to the accompanying drawings, wherein:

FIG. 5 shows an exemplary message for activity reduction in an embodiment of a third implementation of a method for activity reduction disclosed herein;

DETAILED DESCRIPTION

Figure 1:
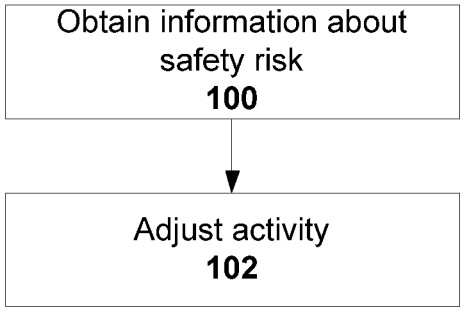
FIG. 1 shows schematically an embodiment of a method for activity reduction disclosed herein.

FIG. 1 shows schematically an embodiment of a method for activity reduction disclosed herein. Safety risk information for a pedestrian at risk for involvement in an accident is obtained in step 100. The risk information is used to adjust a PU communication activity (e.g. reduce transmission) in step 102. The adjustment will lead to reduced network congestion and increased PU battery life. The description next provides three exemplary implementations of the steps for obtaining the risk information and adjusting the PU activity.

Figure 2:
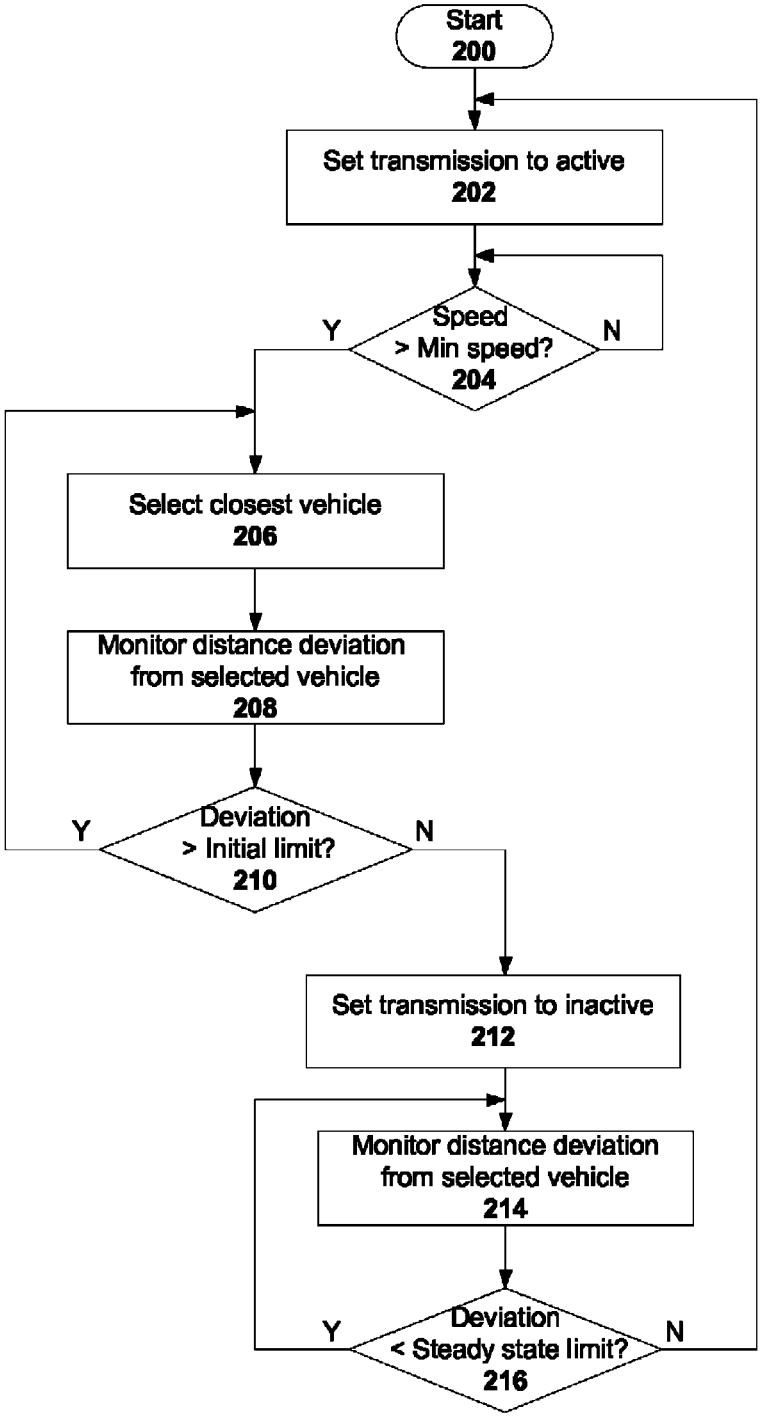
FIG. 2 shows schematically an embodiment of a first implementation of a method for activity reduction disclosed herein.

In a first implementation, the obtaining of risk information includes detecting if a person is sitting inside a vehicle, in which case the person poses no risk as all or poses a lower risk than when not sitting inside the vehicle. FIG. 2 shows schematically an embodiment of this implementation. The person is assumed to have a respective PU which includes a GPS receiver. If the person is found to be located inside a vehicle, transmission by his/her respective PU is adjusted (reduced or prevented by setting the PU to "inactive").

The operation begins in step 200. Transmission is set to "active" in step 202. A pedestrian speed for a particular pedestrian, determined from data obtained by his/her PU GPS receiver, is compared with a minimal speed value in step 204. Exemplarily, the minimal value may be 10 km/h. If the pedestrian speed is below the minimal value (a situation which may arise if the pedestrian is immobile, e.g. stands next to a vehicle instead of being a person inside the vehicle), operation returns to step 204. In addition, the distance between vehicles grows with increasing vehicle speed, rendering the correlation of pedestrian location with vehicle location more distinct. If the pedestrian speed in step 204 is higher than the minimal value, operation continues from step 206 in which a vehicle closest to the pedestrian is selected after checking the distance from the pedestrian to all vehicles in his/her proximity. In step 208, a deviation of the distance ("distance deviation") between the selected (closest) vehicle and the pedestrian is monitored over a certain time period, for example 10 seconds or more. The distance deviation can take the form of a maximal absolute value or of an average value and is used to declare an "alignment" between the selected vehicle and the pedestrian. In step 210, the measured distance deviation is compared with a first deviation threshold (e.g. 5 meters). If the deviation is larger than the threshold, then a wrong vehicle was selected as "closest" in step 206 (i.e. the selected vehicle and the pedestrian are not "aligned"), and operation resumes from step 206. Otherwise (selected vehicle and pedestrian are "aligned"), operation continues to step 212, in which transmission is set to inactive. For the period the transmission is inactive, the PU reception may be activated periodically, e.g. less that 10% of the period. GPS tracking speed can be lowered as well. The measured deviation is then compared in step 216 with a second, larger deviation threshold (e.g. 10 meters), to accommodate high GPS errors after initial lock. If the measured deviation is smaller than the second threshold, the vehicle and pedestrian are still aligned and step 214 is repeated. Otherwise, operation returns to and is repeated from step 202, turning the transmission back on to active after discovering that the closest vehicle selection in step 206 was wrong, or that the pedestrian is not a person inside the vehicle.

Figure 3:
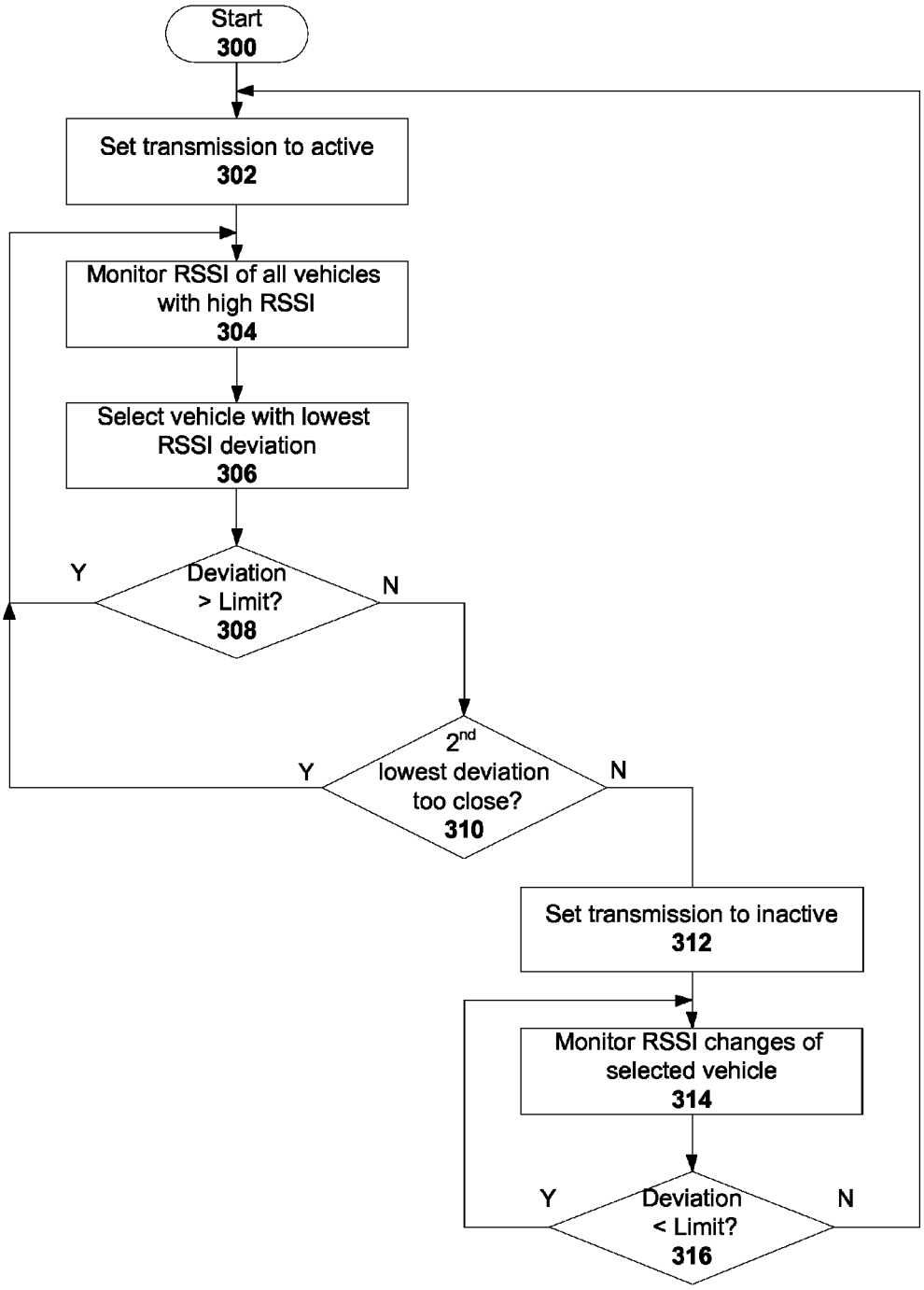
FIG. 3 shows schematically an embodiment of a second implementation of a method for activity reduction disclosed herein.

In a second implementation, the PU does not have a GPS receiver, to reduce cost and remove the challenge involved in GPS antenna placement. As in the previous implementation, the obtaining of risk information includes determining whether a person is inside or outside a vehicle. This is done using a Receive Signal Strength Indication (RSSI). As in the first implementation, if it is determined that the person is inside a vehicle, transmission by his/her respective PU is inactivated. This embodiment is shown schematically in FIG. 3. The PU performs all the following actions. The operation begins in step 300. Transmission is set to active in step 302. The RSSI of surrounding vehicles is monitored in step 304. The monitoring lasts for several seconds (for example 10 seconds or more). A high RSSI value, for example above −55 dBm, is used to identify vehicles with very short distance from the person associated with the PU. If, for a particular vehicle, the deviation of different RSSI measurements from a given value over the monitored period is low, then the person has a fixed location relative to that vehicle, not impacted by environment or vehicle movement. This indicates that the person is inside that vehicle. The vehicle with the lowest RSSI deviation is selected in step 306. The measured RSSI deviation is compared with a threshold (limit) in step 308. For example, the threshold may be 4 dB. If the deviation is greater than the threshold, the operation returns to step 300, to keep looking for vehicles matching the criterion (RSSI higher than −55 dBm). If the deviation is lower than the threshold, operation continues to step 310 in which the difference between the lowest RSSI deviation and the second lowest RSSI deviation is calculated The difference between the two deviations should be larger than a predetermined value, for example 3 dB, or else the selection of a vehicle as the one with the most "stable" RSSI is not confident enough. If the difference is smaller than the predetermined value, the operation continues from step 300, repeating the process. If the difference is larger, the person is considered as "aligned" with the vehicle and operation continues to step 312. Consequently and paralleling step 212 above, in step 312 transmission is set to inactive (thereby reducing activity). The RSSI of the selected vehicle is further monitored to assure that the alignment between vehicle and person continues in step 314. The RSSI deviation is compared with a second threshold in step 316. The second threshold is chosen to be higher than the first threshold, to allow slack after initial alignment declaration. For example, the second threshold may be higher by 2 dB than the first. If in step 316 the deviation is smaller than the second threshold, then the selected vehicle is still aligned with the person and monitoring resumes from step 312. If the deviation is larger, operation returns to step 302, and transmission is turned back to active. This is followed by searching for and selecting a new vehicle.

Reducing Activity Based on Risk Assessment Provided by Vehicles

In a third implementation, the obtaining of risk information includes obtaining and analyzing a pedestrian safety risk. The analysis includes determination that a person (here a pedestrian) is outside a vehicle and determination, from vehicle transmissions, that a particular pedestrian is not close to a road. The vehicles transmit "activity control" messages which are received at a PU associated with the particular pedestrian. Each message includes information which indicates whether a particular pedestrian is close or not close to the road. An "activity factor" between 0-100% is calculated by the PU based on the information. If a message indicated that a particular pedestrian is not close to a road, the calculated activity factor will be low (e.g. 10%). The transmission activity of the PU associated with that particular pedestrian is then set according to the factor (in the example to 10%). Since during most of the time a pedestrian does not impose any risk, the activity factor can be decreased significantly, achieving the goal of transmission power reduction. The following describes in more detail the actions above.

Figure 4:
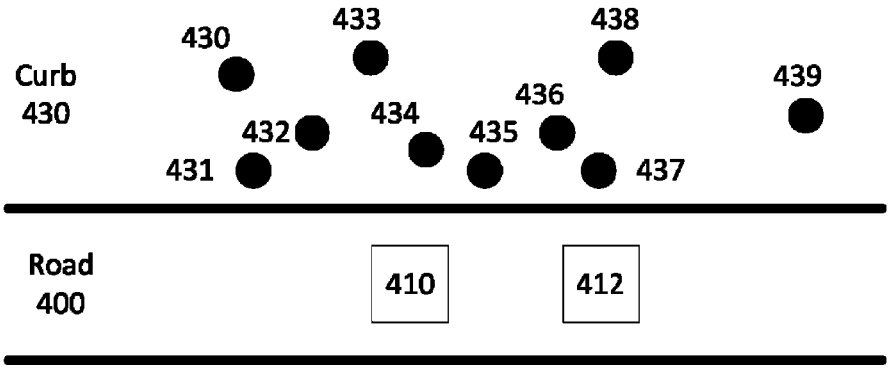
FIG. 4 illustrates schematically an environment which includes pedestrians and vehicles.

FIG. 4 illustrates schematically an environment which includes pedestrians and vehicles. Two vehicles, 410 and 412, drive on a road 400. Ten pedestrians, marked 420 to 429, are on a curb 430. The pedestrians closest to the road (421, 425 and 427) are identified as posing the greatest safety risk. These three pedestrians should be more visible to vehicles than other pedestrians. Higher visibility is reflected by higher respective PU transmission rate.

An exemplary activity control message which may be propagated by all units in a PVCN in this implementation is illustrated in FIG. 5. The message includes the following fields:

Pedestrian imposing safety risk (field 500): Binary field with Yes/No possible values.

Pedestrian activity control (field 502): Binary field with Enable/Disable possible values.

Activity re-enable distance (field 504): Field [in meters] of movement till pedestrian unit should resume activity.

Activity re-enable direction (field 506): Field [in angles] of movement direction which is considered for distance calculation mentioned above.

A message including only a subset of these fields can also be designed. The fields can be refined to greater degree of description if needed. For example, safety risk can be graded, instead of a plain Yes/No.

Figure 6:
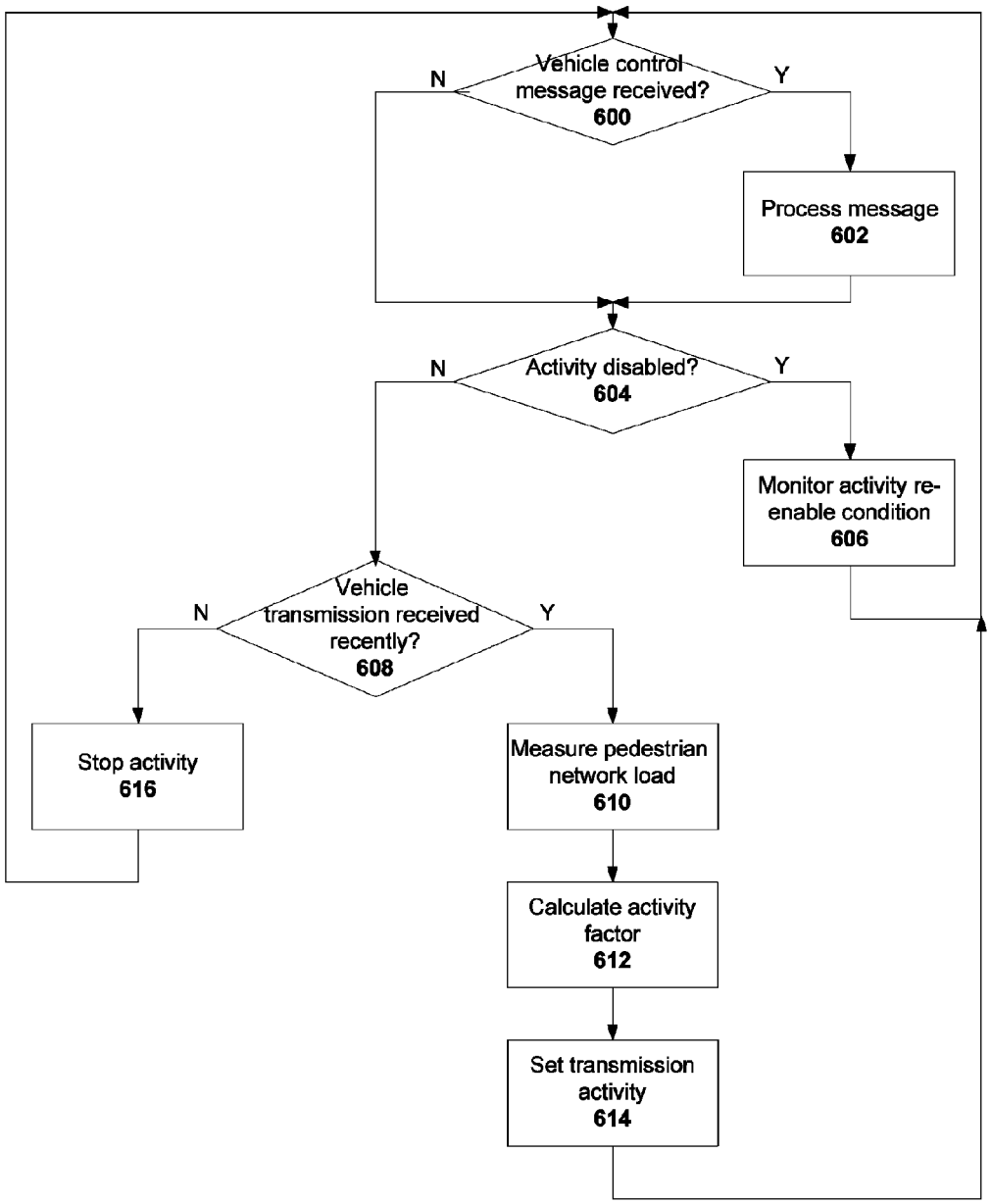
FIG. 6 shows a flow chart of a pedestrian unit operation in the embodiment described in FIG. 5.

FIG. 6 shows a flow chart of PU operation in this implementation. All steps are performed by a "receiving" PU. In step 600, a check is performed to determine if an activity control message was received from a vehicle. If such a message was received, it is processed in step 602 by the receiving PU. The processing includes parsing all fields. If an enable control message was received, then the receiving PU is enabled. If a disable control message was received, then the receiving PU is disabled unless prohibited by a recent message from a different vehicle. The condition for enabling is recorded by the PU. Operation continues from step 604 in which a check is performed to check if activity is disabled. If YES, the condition for re-enable is checked in step 606. If the condition is satisfied, then activity is re-enabled and the operation returns to step 600. If NO in step 604, operation continues from step 608. If no transmission of any message as above was received recently, for example over the last 5 seconds, then activity is stopped in step 616. This is followed by returning to step 600. If transmission was received, operation continues from step 610, in which pedestrian network load is measured. Network load measurement is known in the art, and existing schemes of counting the number of received packets or measuring a period of time in which received energy is above a threshold can be applied. The operation is followed by calculating the activity factor in step 612 and setting the transmission activity accordingly in step 614. The activity factor calculation considers the load of the pedestrian network (obtained e.g. from measuring the number of PUs which transmitted during the last 1 second, or using an equivalent method know in the art) and the information received from the vehicle control message, and in particular the number of vehicles that identified the pedestrian as posing a safety risk. The logic for calculation is exemplarily as follows:

Increased pedestrian network activity should reduce PU activity to decrease load.

Increased number of vehicles identifying a pedestrian as imposing a safety risk should increase PU activity for better visibility.

These two statements are combined to a single table. Table 1 includes an example for possible values:

TABLE 1

| Pedestrian communication network load | Pedestrian not marked as imposing risk | Pedestrian marked once as imposing risk | Pedestrian marked twice or more as imposing risk |
|---|---|---|---|
| Low | Medium activity | High activity | High activity |
| Medium | Low activity | High activity | High activity |
| High | Low activity | Low activity | High activity |

The table may be extended to include more input values for network load or consider the load as continuous, instead of the discrete classification applied here. The table may also include finer granularity for activity level instead of only "low, medium, high".

The PU operations in FIG. 6 must be kept very simple to meet the requirement of low processing power. As can be seen, the operations and decision elements are fairly simple, and meet the requirement.

Figure 7:
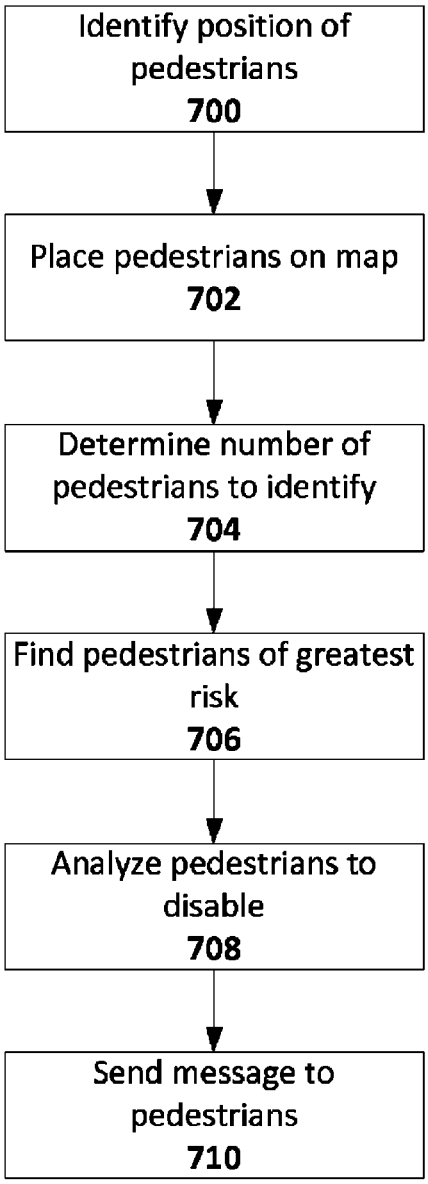
FIG. 7 shows a flow chart of a vehicle unit operation in the embodiment described in FIG. 5.

A flow diagram of vehicle operation in this implementation is shown in FIG. 7. The vehicles perform the complex calculations. The operation begins in step 700 by identifying the positions of all pedestrians within communication range. The positions may be transmitted by PUs (when these include a GPS receiver) or by positioning schemes applied by a particular vehicle, similar to radar mechanisms, for example as described PCT patent application PCT IB2009/051769. The pedestrians are placed on a map in step 702. The map must be very accurate to detect exact road boundaries. The map may be provided from a database or learned by the vehicle. Various alternatives exist for placing pedestrians on a map.

Step 704 considers the vehicle speed in determining the number of pedestrians to identify as posing a risk. The faster the vehicle drives, the greater potential danger it poses to pedestrians, and the greater is the responsibility of the vehicle to identify pedestrians, since the distance between vehicles grows, and the number of vehicles on road is lower. For these reasons, a fast moving vehicle should be able to identify more pedestrians posing a safety risk than a lower moving vehicle. An example for slow vehicles includes many vehicles stopping at intersection during a red light. If each vehicle identifies several pedestrians as posing a risk, then all the pedestrians crossing the road will be marked as posing a big risk, which is likely to overwhelm the network. More dangerously, this will prevent vehicles from selecting other pedestrians, not crossing on the crosswalk. An example for selection of a number of pedestrians at risk is described in Table 2:

TABLE 2

| Vehicle speed | Maximal number of selected pedestrians |
|---|---|
| <10 km/h | 0 |
| <25 km/h | 1 |
| <40 km/h | 2 |
| Else | 3 |

Other values may be used. The pedestrians posing the safety risk are identified in step 706. The criterion is the distance of a pedestrian from the road, with the risk increasing with decreasing distance. The challenge is to ignore all pedestrians except those (one or more) closest to the road, and to avoid repeated selection by all vehicles of the same pedestrians. For this reason, a criterion of distance from vehicle is applied to limit the range of identification, so as to limit overlapping decisions of different vehicles. An exemplary scheme could be to select the pedestrians closest to the road between a current vehicle location and a certain distance that the vehicle will travel on the road ("road segment"), for example 25 meters. If the number of pedestrians with distance to the road of less than the certain distance (for example, 2 meters) is below required, then operation continues to the next segment, (which may be between 25 meters to 50 meters ahead), then to the next, etc. Optionally, in step 708, the vehicle can instruct a PU to disable its activity based on its location. For example, if the vehicle identifies that the pedestrian is 30 meters from the closest road ("not at risk"), then the vehicle can instruct the PU to disable until the pedestrian moves 20 meters from his/her current location. In this example, the pedestrian will be at least 10 meters from the road when his/her PU is re-enabled. Since the pedestrian movement direction is not specified, the pedestrian can be much further away. Optionally, the movement direction can be added to refine the condition. In step 710, after the pedestrians posing a risk are identified by a vehicle, their identities are attached to vehicular messages as defined in FIG. 5 and transmitted.

While this disclosure has been described in terms of certain embodiments and generally associated methods, alterations and permutations of the embodiments and methods will be apparent to those skilled in the art. The disclosure is to be understood as not limited by the specific embodiments described herein, but only by the scope of the appended claims.

The invention claimed is:

1. A method for communication activity reduction in a pedestrian-to-vehicle communication network comprising steps of:

a) obtaining pedestrian safety risk information related to a particular person; and b) based on the obtained pedestrian safety risk information, adjusting the communication activity of a personal communication unit (PU) associated with the particular person.

2. The method of claim 1, wherein the step of obtaining pedestrian safety risk information includes determining whether the particular person is located inside a vehicle.

3. The method of claim 2, wherein the determining whether the particular person is located inside a vehicle includes obtaining a pedestrian speed based on global positioning system (GPS) data and comparing the pedestrian speed to a predetermined speed value.

4. The method of claim 3, wherein, if the pedestrian speed is higher than the predetermined speed value, the determining further includes detecting a vehicle closest to the particular person and monitoring a distance deviation between the particular person and the closest vehicle over a predetermined time period.

5. The method of claim 4, wherein, if the distance deviation is smaller than a first deviation threshold, the particular person is determined to be inside the closest vehicle, and wherein the step of adjusting a communication activity includes reducing PU transmission.

6. The method of claim 2, wherein the determining whether the particular person is located inside a vehicle is based on monitoring received signal strength indications (RSSI) of vehicles surrounding the particular person.

7. The method of claim 6, further comprising the step of using the monitoring to determine a most stable RSSI and a particular vehicle associated therewith, wherein the particular person is determined to be inside the particular vehicle with the most stable RSSI.

8. The method of claim 7, wherein the step of adjusting a communication activity includes reducing PU transmission.

9. The method of claim 1, wherein the step of obtaining pedestrian safety risk information includes determining that the particular person is not inside a vehicle and receiving at the PU a message with information on at least one risk factor, and wherein the step of adjusting the communication activity includes adjusting the communication activity based on the at least one risk factor.

10. The method of claim 9, wherein the adjusting the communication activity based on the at least one risk factor includes using the at least one risk factor to calculate an activity factor and using the calculated activity factor to set the communication activity.

11. The method of claim 9, wherein the message is an activity control message sent by a vehicle having a respective vehicle speed.

12. The method of claim 11, wherein the step of obtaining pedestrian safety risk information further includes: by the vehicle, positioning all pedestrians within range on a map, using the positioning of each pedestrian and the respective vehicle speed to identify at least one pedestrian at risk including at least one risk factor related to the at least one risk in the activity control message.

13. The method of claim 1, wherein the step of obtaining pedestrian safety risk information includes determining that the particular pedestrian is not inside a vehicle and waiting for an activity control message, and wherein, if such a message is not received within a predetermined time period, the step of adjusting the communication activity includes stopping the activity until a next check for activity control message arrival.

14. A method for communication activity reduction in a pedestrian-to-vehicle communication network (PVCN) comprising steps of:

a) determining whether a particular person is located inside a vehicle by obtaining a pedestrian speed based on global positioning system (GPS) data, by establishing, that the pedestrian speed is higher than a predetermined speed value, and by detecting a vehicle closest to the particular person and monitoring a distance deviation between the particular person and the closest vehicle over a predetermined time period; and b) if the particular person is determined to be located inside a vehicle, disabling personal communication unit (PU) associated with the particular person, thereby reducing communication activity in the PVCN.

15. The method of claim 14, wherein the particular person is determined to be inside the closest vehicle if the distance deviation is smaller than a first deviation threshold.

16. The method of claim 14, wherein the determining whether the particular person is located inside a vehicle is based on monitoring received signal strength indications (RSSI) of vehicles surrounding the particular person.

17. The method of claim 16, further comprising the step of using the monitoring to determine a most stable RSSI and a particular vehicle associated therewith, wherein the particular person is determined to be inside the particular vehicle with the most stable RSSI.

* * * * *